United States Patent [19]

Larsson

[11] Patent Number: 4,562,630

[45] Date of Patent: Jan. 7, 1986

[54] METHOD FOR THE MANUFACTURE OF HEAT EXCHANGER ELEMENTS

[76] Inventor: Gunnar Larsson, Sonnenberg 3, D-7770 Überlingen, Fed. Rep. of Germany

[21] Appl. No.: 309,745

[22] Filed: Oct. 8, 1981

[30] Foreign Application Priority Data

Oct. 21, 1980 [DE] Fed. Rep. of Germany ..... 3039693

[51] Int. Cl.[4] ..... B23P 15/26; B21B 17/02

[52] U.S. Cl. ..... 29/157.3 R; 228/155; 228/183; 228/173.4; 228/173.7; 228/158; 29/157.3 D; 29/423; 29/157.3 A; 72/369; 72/370

[58] Field of Search ..... 29/157.3 D, 157.3 R, 29/423, 157.4, 157.3 A, 157.3 B; 72/369, 370; 228/155, 183, 158, 159, 160, 173.1, 173.2, 173.3, 173.4, 173.5, 173.6, 173.7

[56] References Cited

U.S. PATENT DOCUMENTS

| | | | |
|---|---|---|---|
| 2,458,189 | 1/1949 | Morgan | 29/423 UX |
| 2,731,713 | 1/1956 | Schaefer | 29/423 |
| 2,841,866 | 7/1958 | Schilling | 29/423 |
| 2,905,064 | 9/1959 | Nielsen | 29/423 UX |
| 2,988,809 | 6/1961 | Hall | 29/423 |
| 4,274,186 | 6/1981 | Pringle | 29/157.3 D |

*Primary Examiner*—Howard N. Goldberg
*Assistant Examiner*—Vernon K. Rising
*Attorney, Agent, or Firm*—Murray, Whisenhunt and Ferguson

[57] ABSTRACT

The invention relates to a method and an apparatus for the manufacture of heat exchanger elements. A pair of strips of weldable material e.g. high-grade steel is welded together in such a way that on both sides a longitudinally extending weld seam is formed, said pair of strips between said longitudinally extending weld seam defining a longitudinal channel which extends parallel to the weld seams and which serves for the conduction of heating or cooling agents. At least one of the strips is first provided with at least one longitudinally extending groove and is longitudinally welded to the other strip of the pair of strips in such a way that the groove forms with the part of the other strip covering it a longitudinal channel. A liquid filler material is poured into the longitudinal channel and solidified by cooling to below its freezing point. The pair of strips with the solidified or frozen filler material serving as a supporting core is subsequently shaped by plastic deformation of the walls without cutting in such a way that the longitudinal channel hereby acquires the desired shape and finally the frozen filler material is rethawed and removed from the deformed channel.

11 Claims, 17 Drawing Figures

METHOD FOR THE MANUFACTURE OF HEAT EXCHANGER ELEMENTS

A method is already known (GB patent No. 960 972), whereby heat exchanger elements are manufactured from strips or sheets of weldable steels, by first providing such a strip or sheet stepwise by pressing means with corrugations which form recesses and/or projections and which extend transversely to the longitudinal direction of the strip, in such a way that the corrugations do not extend over the whole width of the strip, but leave edge regions of undeformed material at the edges. Subsequently, two strips shaped without cutting in such a way by the intermittent pressing method are combined in pairs into a pair of strips in such a way that the edge regions lie over and adjacent to each other, while the corrugations or recesses and projections of the two strips are offset from each other in the longitudinal direction so that in the region of the row of corrugations, the strips do not abut each other, but form a meanderlike serpentine channel extending in the longitudinal direction. Subsequently, the edge regions are welded, while at the ends of the longitudinal channels openings are made for conducting in and out that medium which is to flow through the heat exchanger element for cooling or heating. A further advantage of the corrugations, which could also be designated as a kind of "transverse folds", consists in addition to the increase in heat transfer area compared with non-serpentine longitudinal channels in that the mechanical strength is improved and the flexibility of the heat exchanger elements transversely to the longitudinal direction is improved. A disadvantage of the previously known method consists on the other hand in that the intermittent method of manufacture limits the speed of manufacture with regard to production technology.

It is also conceivable to manufacture heat exchanger elements by first longitudinally welding two strips to produce a longitudinal channel without any corrugations in the channel walls, whereupon the tube defined by the two strips is bent such that the channel acquires the desired final shape of use, e.g. the shape of a spiral. Prior art, however, does not present any solution how to reduce this conceivable idea to practice. When bending the tube into spiral shape there will namely spontaneously arise folds in the inner strip, as the channel according to prior art is not filled with a core for supporting the channel walls during the bending operation, and this particularly concerns the inner windings of the spiral where the radius of the spiral is comparatively small.

The invention is based on the object of solving the above mentioned problems by a method and an apparatus serving to carry out same with simple means to the effect that in respect of their effect, at least equally good heat exchanger elements can be manufactured, but manufacture itself can be accomplished even more easily, rapidly and better than according to prior art.

The invention consists in that at least one strip of the pair of strips is first provided with at least one longitudinally extending groove and longitudinally welded to the other strip of this pair of strips in such a way that the groove forms with the part covering it, in particular likewise a longitudinal groove, of the other strip, a longitudinal channel, that then a liquid filler material is poured into this longitudinal channel and solidified by cooling to below its freezing point, and that the pair of strips with the solidified or frozen filler material serving as a supporting core is subsequently shaped by plastic deformation of the walls without cutting so that the longitudinal channel acquires the desired shape. After this the frozen filler material can be rethawed and removed from the deformed channel which is then available for receiving the heating or cooling medium.

In other words, non-cutting shaping of the weldable strips is divided into two sections, namely, firstly groove and channel formation, and secondly deformation of the walls of the groove and hence of the longitudinal channel. In this latter shaping, in which corrugations extending in particular transversely or even obliquely to the longitudinal direction of the longitudinal channel are produced in an offset arrangement in the two strips and/or the channel is caused to acquire a spiral shape, the solidified filler material forms a core for supporting the longitudinal channel walls of the two strips being shaped without cutting. It has been shown that in particular water is eminently suitable as a filler material.

Already known per se is the practice of filling for example pipes with sand, resin or low melting alloys in order to prevent, during bending thereof, the cross-section from being deformed in an undesirable manner, in particular substantially reduced. Correspondingly, also known in northern countries is the practice of filling piping with water in order to be able to bend it like concrete reinforcing rods after solidification on cold winter nights. Although these measures of the trade have been known and applied for centuries in the bending of pipes, they have not hitherto been used in the manufacture of heat exchanger elements as with the invention, but—as explained at the beginning—more elaborate measures have been taken. Furthermore, the invention is also not limited to the application of such bending methods, which have been known previously for generations, to the concept of the kind of the invention, for the invention goes far beyond this.

Moreover, also for a long time has been known the practice of deforming pipes and other hollow bodies in dies and moulds using liquids, flowable metals, rubber or the like. Also in the packaging industry is known the practice of dividing a plastic tube filled with filler material, for example milk, by transverse sealing into for example tetrahedron-shaped packages.

Finally, cold working of for example austenitic steels is not new either, as the accelerated martensite formation strengthens stressed parts of the workpiece. As such measures are however used for other purposes than with the invention, the fact that same was previously known does not call into question the level of invention.

It is a particular advantage of the invention that the whole method and not only welding of the longitudinal seams in contrast with the sequential step-by-step method can take place continuously, which offers many advantages both with respect to the rapidity of the method of manufacture and the expenditure on apparatus; thus for example individual units do not have to be constantly accelerated and braked, which apart from a high expenditure of energy also leads again and again to vibrations of an undesirable kind. Thus it is advisable to carry out the method at an advance or conveying speed of between about 1 and 8 m/min, which approximately corresponds to the seam welding speed.

At the same speed, the strip-like heat exchanger elements can then be rolled up or bent into the final shape of use; here it may also be advisable to leave the filler material still in the solidified state and not until after this rolling up, bending or the like shaping to change it to the liquid state and let it flow out of the longitudinal channel system. This bending operation can be performed after the strips have been corrugated as above described, but it is also possible within the scope of the invention to use the continuous shaping of the channel for the bending operation only when it is desired to produce a heat exchanger element, the channels of which have non-corrugated walls.

To carry out the method according to the invention, a plurality of weldable material, in particular welding steels, among them high-grade steels, are usable. Particular advantages are offered by stainless V2A steel, with which welding is carried out even with water cooling. But even unalloyed steels are usable; care is however to be taken that the steels are plastically workable at the low temperature which is necessary to let the filler material freeze. If water is used, it is advisable to cool this to about −10° C., i.e. to produce a sufficient gap to freezing point, in order to avoid the solidified filler material shaping core being reliquefied during the course of the non-cutting shaping process in any event to the extent that it can no longer sufficiently fulfill its task as shaping core.

The thickness of the strips, in particular sheets, preferably amounts to between 0.5 and 2.0 mm.

It is particularly advantageous if the pair of strips is filled with the liquid filler material and cooled in a downwardly, in particular obliquely downwardly inclined path, because then the filler material solidifying in the lower part in a freezing station forms a "plug" which closes the cross-section of the longitudinal channel, so that filler material flowing from above cannot flow out downwardly, but there is automatically always an adequate liquid head of the filler material present over the already solidified filler material. As a cooling agent liquid nitrogen may be used.

Production of a serpentine course of the longitudinal channels in the direction of conveying behind the freezing station may take place in an appropriate manner by shaping rolls which exhibit projections and recesses at the surface, whereby the corrugation-like structures can be impressed on the longitudinal channels. In order for a cross-section which is constant as far as possible to remain in the longitudinal direction of the longitudinal channels, it is advisable therein to offset these shaping rolls from each other with respect to their projections and recesses in such a way that in the one strip precisely a projection or bulge is formed when in the other strip at the overlapped point precisely an indentation or recess is formed. This does not however exclude the possibility of also manufacturing according to the invention those heat exchanger elements in which in the longitudinal direction of the longitudinal channels large and small cross-sections alternate.

As is also shown further with the aid of the drawings, the shape of the groove-like longitudinal channels may assume a great variety. Furthermore, it may be appropriate to arrange several longitudinal channels parallel and adjacent to each other at any given time in a pair of strips.

The method according to the invention moreover renders it possible, for example by exchanging the shaping rolls, for the type of serpentine course of the longitudinal channels to be capable of being developed in such a way that subsequent bending is facilitated. In dependence upon the direction of bending it is then appropriate to dimension or shape the form of the corrugation-forming recesses and projections or "peaks" and "valleys" at the surface of one shaping roll somewhat differently than on the other shaping roll.

It is understood that the method is not restricted to the use of rollers as shaping tools, but also shaping dies are usable. As far as the continous method is applied, such shaping tools, as is already known for example in the packaging industry, would have to be moved with advance or with conveyance of the pair of strips in abutment therewith and after lifting off returned again in the opposite direction.

Further developments of the invention are claimed in subsidiary claims and are also explained, at all events partially, in the following description of the diagrams.

In the drawings:

FIG. 1 shows a schematic side view (partly in section) of an apparatus according to the invention for carrying out the method according to one embodiment of the invention;

FIGS. *2a–2g* show the cross-sections of various pairs of strips with different longitudinal channel cross-sections in a schematic view.

Figure 6:
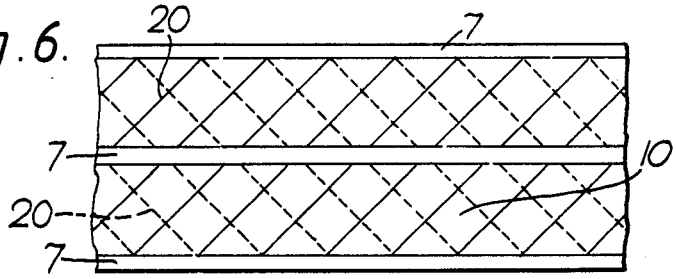
Figure 8:
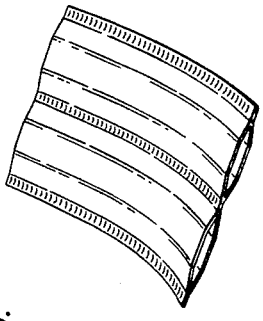
Figure 9:
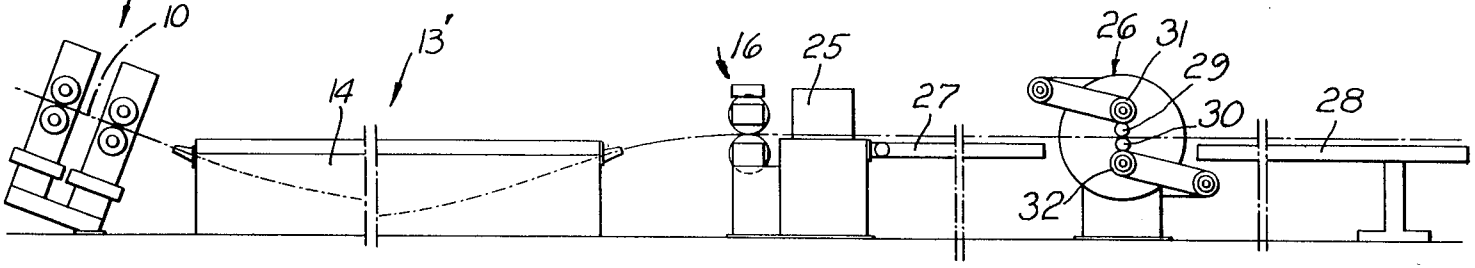

FIG. *5a* and *5b* show a pair of strips in front view and top view;

FIG. 6 shows such a pair of strips of different construction in top view;

FIG. *7a* and *7b* show a side view and a top view of a spirally bent heat exchanger element according to the invention;

FIG. 8 shows a portion of a pair of welded strips bent to the final shape of use, where the strip walls in this case have not been corrugated;

FIG. 9 shows a schematic side view of an apparatus according to a second embodiment for carrying out the invention.

Figure 1:
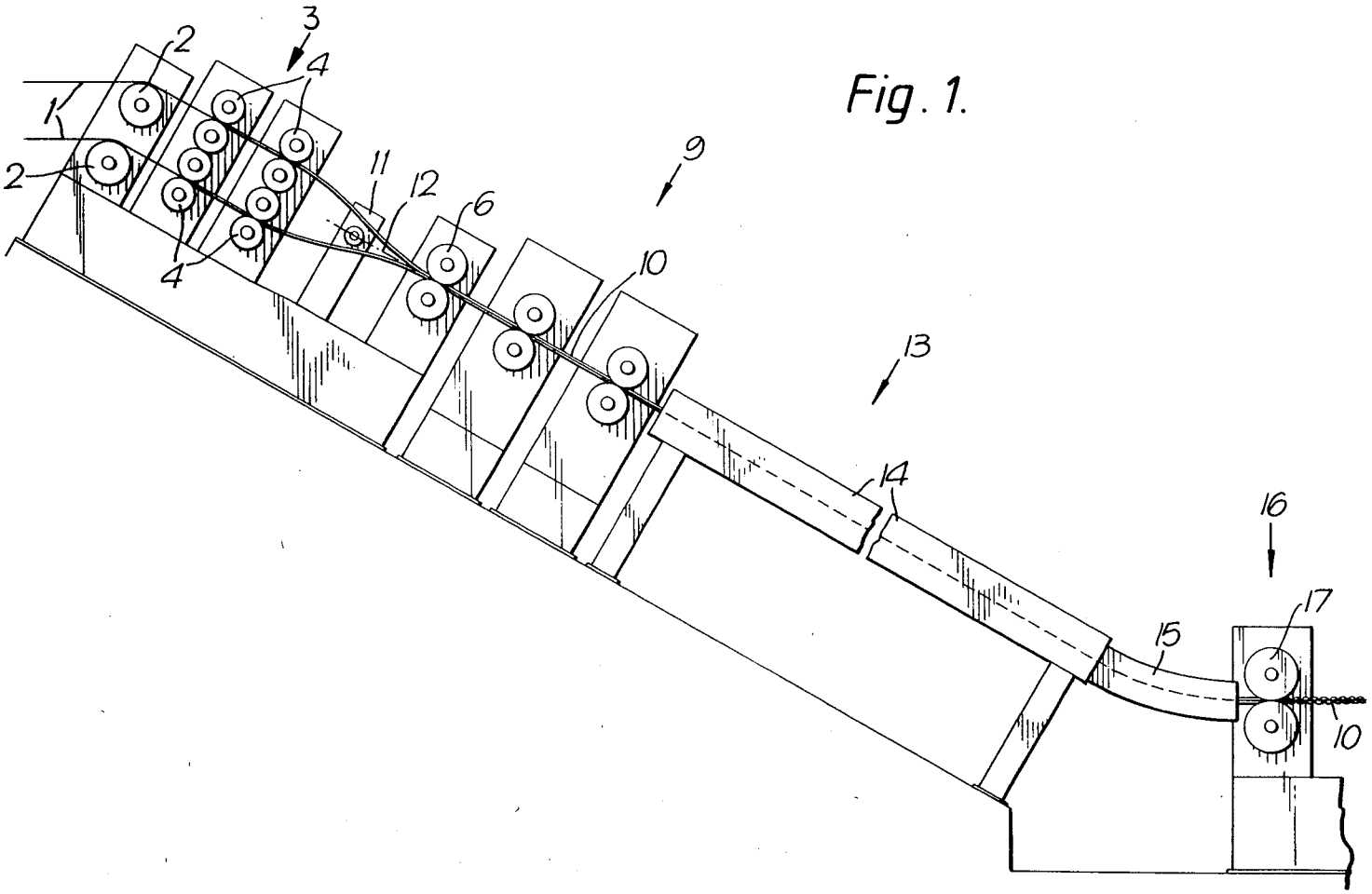

According to FIG. 1, two flat strips 1 with a strip thickness of for example 1 mm are supplied via two deflector rollers 2 to a preshaping station 3 in which the two strips 1 are guided through roll passes 4 which form longitudinally extending grooves 5 (see in particular FIG. 2) in the strips 1. The strips 1 provided with such grooves 5 are then guided together as far as a roll pass 6 in such a way that the strip portions still in the flat state, in particular the strip edges 7, lie adjacent to each other, while the grooves 5 stand apart from each other and form a longitudinal channel 8 extending in the longitudinal direction. Instead of one longitudinal channel 8, there may also be provided several parallel longitudinal channels 8 in particular according to the examples of embodiments of FIG. 2. In the welding station 9, the strip portions lying adjacent to each other, in particular longitudinal edges, are joined to each other by joint welding, for which seam welding is particularly recommended. As continuously effective welding methods of this kind are known for the production of weld seams, these are not explained in detail here.

In the welding station 9, provision is made for the continuous weld seams to close off the longitudinal channel or channels of the now formed pair of strips 10, so that—apart from the front and rear openings—longitudinal channels sealed off from the outside are present. Into these, liquid filler material is now introduced into the longitudinal channel with the aid of a filling device 11 shown only schematically for example via a pipe 12 introduced between the strips 1 and into the relevant longitudinal channel 8 of the pair of strips 10. This flows as a result of the inclination of the pair of strips in FIG. 1 downwardly to the right and is there solidified in the longitudinal channel 8 within the freezing station 13. The freezing station 13 is supplied in particular with such cooling agents as bring the filler material, in particular water, to a temperature of in particular about 10° below freezing point, in the case of water −10° C. Also lower temperatures may be considered. Liquid nitrogen may be a suitable cooling agent. The freezing station 13 exhibits a freezing tunnel 14 through which the pair of strips 10 is passed. The filler material solidifying therein prevents the still liquid filler material from flowing out downwardly and ensures that as a result of the filler material upstream there always remains through the filler pipe 12 a sufficient liquid head above the already solidified filler material, in order for a shaping core extending continuously in the longitudinal direction of the longitudinal channels through the latter to be formed.

Figure 3:
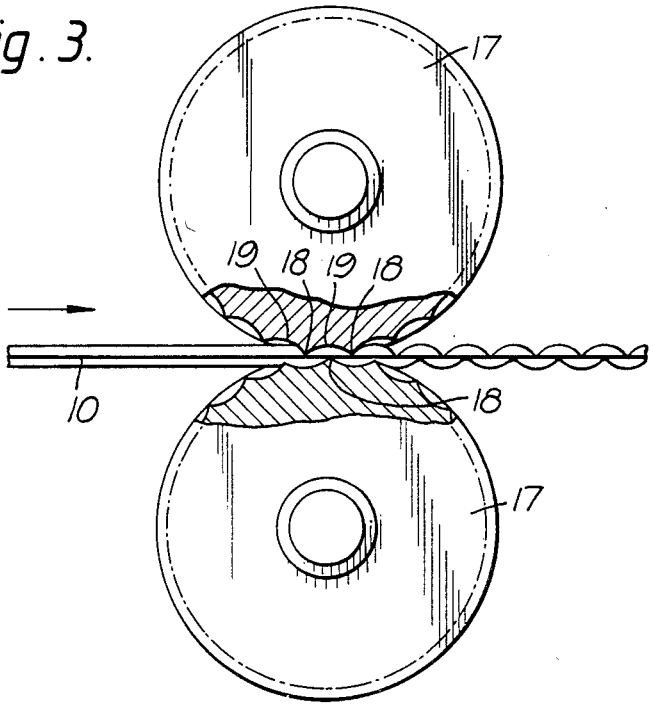
FIG. 3 shows a schematic cross-section of a shaping station with two shaping rolls acting on the pair of strips and shaping them without cutting.

In the lower part of the apparatus, a protective conduit 15 provides for the cooled pair of strips 10 still to remain so cold up until entry into the main shaping station 16 that the solidified filler material does not yet soften, but can fulfil its task as shaping core in a main shaping station 16. In the main shaping station 16, both sides of the pair of strips 10 are acted upon by shaping rolls 17 which impart a serpentine course to the longitudinal channel or parallel longitudinal channels 8, as is shown still more clearly in FIG. 3.

For this purpose the surfaces of the shaping rolls 17 exhibit projections 18 and recesses 19. The two shaping rolls 17 are arranged in such a way that their opposed projections 18 and recesses 19 are in an offset arrangement in such a way that a projection 19 of the upper shaping roll 17 is opposite for example the projection 18 of the lower shaping roll 17 acting precisely the most intensively on the pair of strips 10 in FIG. 3. Hereby is produced the serpentine course of the longitudinal channels 8, without the cross-section in the longitudinal direction thereof changing significantly.

Figure 2A:
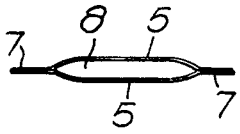
Figure 2B:
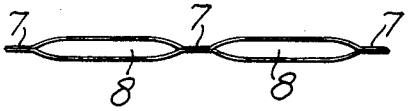
Figure 2C:
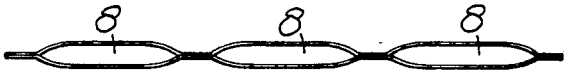
Figure 2D:
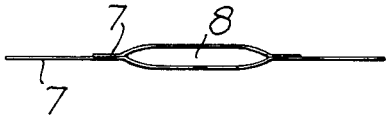
Figure 2E:
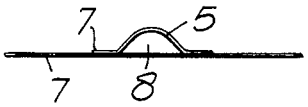
Figure 2F:
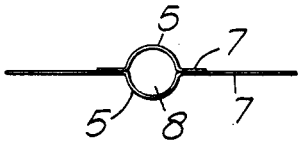
Figure 2G:
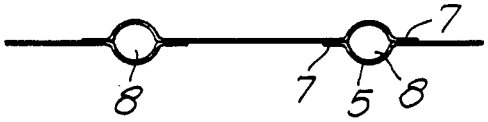

With an advance speed of 2 m/min, a cross-section of the steel of about 2.16 $cm^2$ and a cross-section of three parallel longitudinal channels 8 according to FIG. 2*c* of about 5.2 $cm^2$ as well as a temperature reduction of about 20° C. to about −10° C., energy for freezing of about 63 kcal/m and an energy requirement of about 7600 kcal/h is demanded. The width of such a pair of strips 10 according to FIG. 2*c* herein amounts to 180 mm with a total width of the longitudinal channels 8 of about 4 mm.

As shown in FIG. 2, the cross-sections of the grooves 5 and of the longitudinal channels 8 formed therefrom may be very different. Even the nature of the overlapping flat strip regions 7 can be different, i.e. at all costs even strip material of a strip can protrude beyond the overlapping strip regions of the two strips in the region of the sealing seam, as is shown in particular in FIG. 2*d*–2*g*.

Figure 4:
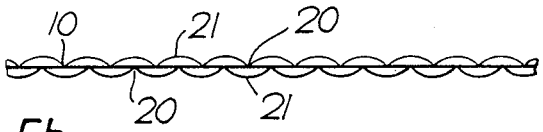
FIG. 4 shows a side view of a heat exchanger element manufactured by the method according to the invention.
Figure 5A:
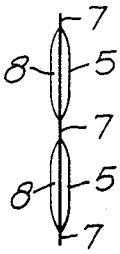
Figure 5B:
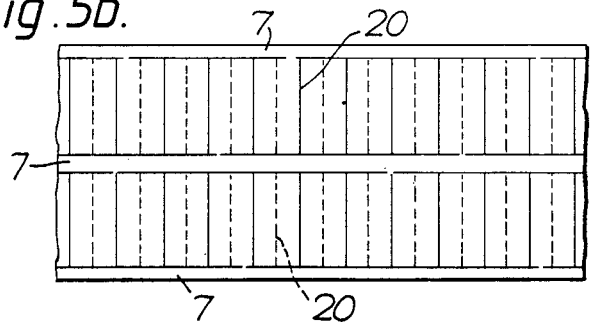

In FIG. 4 is shown the undulatingly or serpentine winding course of the longitudinal channels in side view and in FIG. 5*b* is shown how the two grooves 5 are separated by a longitudinal seam region 7 and bounded on the outside by edge regions 7 joined likewise by means of a longitudinal weld seam. The indentations or recesses 20 are produced by the projections 18 of the shaping rolls 17, according to FIG. 3, while the projections 21 of the pair of strips 10 are yielded by the recesses 19 of the shaping rolls 17. In contradistinction to the course of the recesses 20, according to FIG. 5*b*—turned through 90° in relation to the longitudinal direction of the weld seams 7—the indentations or recesses 20 in the embodiment of FIG. 6 run in a diagonal direction, e.g. turned through about 45° in relation to the longitudinal direction of the weld seams 7 and of the pair of strips 10.

In the direction of conveying behind the main shaping station 16, the pair of strips 10 provided with a serpentine course of the longitudinal channels 8 may be bent. According to FIG. 7*a* and 7*b*, a spiral heat exchanger element is produced herein by clamping a particular longitudinal section of the pair of strips 10 in the middle and then bending it towards the outer ends 10*a* in such a way that the spiral course shown in FIG. 7*b* results. To the two strip ends 10*a* are then connected the inlet and outlet pipes, so that for example a heating medium or cooling agent can enter on one side, pass through the spiral heat exchanger assembly and exit on the other outer side—seen in the radial direction. In the centre 22 of the spiral the pair of strips 10 forms an S-shaped course. The connecting pipes 23 can be seen even better from FIG. 7*a*. By the arrows indicated in the upper part it is made clear that for example a cooling agent enters on the left and exits on the right, while the medium to be cooled, indicated by the lower arrows, passes from bottom to top through the heat exchanger element—between the layers of the pair of strips 10. These layers are kept apart from each other by suitable spacer elements.

The principle of the method according to the invention may also be used to great advantage in an alternative development of the invention. In this development of the invention, the longitudinal channel does not have to be "serpentined" in the transverse direction at all, but it takes on a course which is indeed curved or bent such as for example according to FIG. 7*b* without projections and recesses alternating in the longitudinal direction thereof. In other words, the longitudinally succeeding recesses and projections are moved so infinitely close together that they form only one longitudinally extending groove. The pair of strips then constitutes a kind of "pipe" which exhibits the weld seams on both sides of the longitudinal channel forming the pipe. After pouring in of the liquid filler material and letting it solidify, it forms the equally good supporting core as in the alternative of the invention described in detail at the beginning so that the internally "reinforced" pair of strips can be bent by shaping without cutting. The advantage of the supporting core consists above all in that the cross-section during bending remains practically not only not reduced, but also retentive of shape. FIG. 8 shows a portion of a pair of strips bent in this way, and FIG. 9 shows how this can be carried out in practice as an alternative to or in combination with the formation of the longitudinally succeeding recesses and projections.

It should be understood that the apparatus of FIG. 9 includes a preshaping station of the same kind as the station 3 of Fig. 1. As far as these details are concerned reference is therefore made to the previous embodiment. Also a welding station of the same design as according to FIG. 1 is provided to produce a pair of welded strips 10. Water or other filler liquid is supplied into the longitudinal channel by means of pipe or the like 12 as previously described. The strips 10 with the liquidfilled channel is continuously fed into a freezing station 13', which in this case consists of a conventional freezer of the compressor type. The freezer plant 13' may have a length of about 10 m. After the freezer station 13' there is provided a shaping station 16, which may be identical to the shaping station 16 described with reference to FIG. 1. In this shaping station 16, both sides of the pair of strips 10 may be acted upon by shaping rolls which may impart a serpentine course to the longitudinal channel or parallel longitudinal channels 8, as is shown in detail in FIG. 3.

Figure 7A:
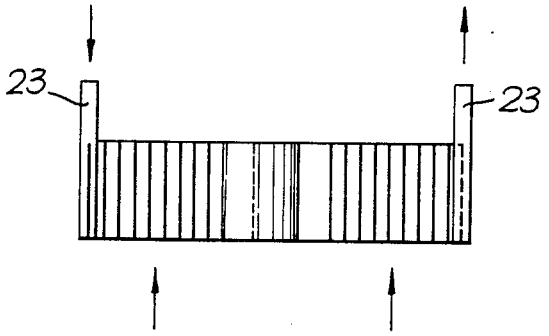
Figure 7B:
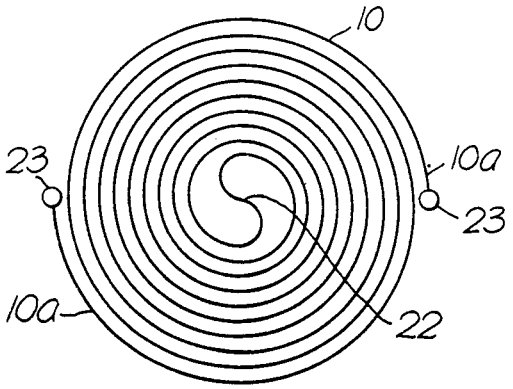

After the shaping or corrugation station 16 there is provided a cutting device 25 adjacent to the corrugation station 16, and at a distance from the cutting device 25 there is provided a final shaping station 26. This final shaping station 26 is designed to impart to the pair of strips 10 a spiral course as shown in FIG. 7*a* and 7*b*. Therefore, between the cutting device 25 and the final shaping station 26 as well as after the final shaping station 26 there are provided two tables 27 and 28, which have a sufficient length—e.g. five to ten meters—to store a sufficient length of strips for producing the spiral. When the strips are resting on the table 27 they are properly isolated or subjected to further cooling such that the filler in the channels 8 may not melt or soften. In the station 26 a pair of rolls has been designated 29 and 30. These are arranged over and beneath the pair of strips to be wound to spiralshape. Therefore, after cutting off a proper length of strips in the device 25, the spiral is readily produced by turning the rolls round the centre between them and under the support of a pair of backing rolls 31 and 32. When the spiral shown in FIG. 7 is finished, the rolls 29 and 30 are removed in the transverse direction.

It should be understood that by means of the apparatus shown with reference to FIG. 9 it is possible to produce corrugated as well as noncorrugated exchanger elements. In the latter case the corrugation station 16 is put out of operation. It should also be understood that it also is possible to produce elements with serpentine channels which are not bent to spiral or any other bent shape but which are intended to be used as straight elements.

I claim:

1. Method for the manufacture of heat exchanger elements comprising a pair of strips of weldable material welded together with at least two longitudinally extending weld seams spaced apart from one another with at least one longitudinal channel extending parallel to the weld seams and between them for the conduction of heating or cooling agents, said method comprising continuously providing a pair of strips of weldable material;

providing at least one strip of said pair of strips with a longitudinally extending groove;

covering said longitudinally extending groove with the other of said pair of strips to form a longitudinally extending channel and continuously welding said pair of strips together by forming at least two longitudinally extending welded seams, at least one of said welded seams fromed on each side of said channel;

feeding a liquid filler material into said longitudinal channel;

continuously conveying said pair of strips containing said liquid filler material in said longitudinal channel in a downwardly inclined path and freezing said liquid filler to form a supporting core by cooling said pair of strips to a temperature below the freezing point of said liquid filler;

continuously shaping said pair of strips containing said supporting core into a predetermined form by plastic deformation; and thawing said frozen filler material and removing said thawed filler material from said shaped pair of strips.

2. The method according to claim 1, wherein said pair of strips is shaped into a meanderlike serpentine course.

3. The method according to claim 1, wherein said pair of strips during said continuous shaping are provided with transversely extending corrugations.

4. The method according to claim 1, wherein said pair of strips during said continuous shaping are provided with obliquely extending corrugations.

5. The method according to claim 3 or 4, wherein the corrugations of one strip of the pair of strips are offset in the longitudinal direction from the corrugations of the other strip.

6. The method according to claim 1, wherein said pair of strips are cooled to a temperature at least 10° C. below the freezing point of said liquid filler material.

7. The method according to claim 1, wherein said pair of strips containing said supporting core are continuously shaped by bending.

8. The method according to claim 7, wherein said pair of strips are bent into a spiral shape wherein adjacent layers of said pair of strips are spaced apart from one another.

9. The method according to claim 7 or 8, wherein said pair of strips are cut to a predetermined length having a first end and a second end and bent into a spiral shape, said first and second ends being located at the radially outer sides of said spiral and a portion of said pair of strips which is substantially centrally located between said first and second end being bent into a substantially S-shape.

10. The method according to claim 7, wherein said frozen filler material is not thawed until after said bending.

11. Method for the manufacture of heat exchanger elements comprising a pair of strips of weldable material welded together with at least two longitudinally extending weld seams spaced apart from one another with at least one longitudinal channel extending parallel to the weld seams and between them for the conduction of heating or cooling agents, said method comprising:

providing at least one strip of said pair of strips with a longitudinally extending groove;

covering said longitudinally extending groove with the other of said pair of strips to form a longitudinally extending channel and continuously welding said pair of strips together by forming at least two longitudinally extending welded seams, at least one of said welded seams formed on each side of said channel;

feeding a liquid filler material into said longitudinal channel;

continuously conveying said pair of strips containing said liquid filler material in said longitudinal channel in a downwardly inclined path and freezing said liquid filler to form a supporting core by cooling said pair of strips to a temperature below the freezing point of said liquid filler;

forming said longitudinal channel into a meander-like serpentine course;

continuously shaping said pair of strips containing said supporting core into a predetermined form by plastic deformation; and thawing said frozen filler material and removing said thawed filler material from said shaped pair of strips.

* * * * *